United States Patent [19]

Calza et al.

[11] 4,310,262

[45] Jan. 12, 1982

[54] COLLAPSIBLE DAM AND APPARATUS FOR RAISING AND LOWERING THE DAM

[75] Inventors: Francesco Calza, Monza; Bruno Borca, Milan, both of Italy

[73] Assignee: Pirelli/Furlanis Applicazioni, Gomma, Italy

[21] Appl. No.: 136,052

[22] Filed: Mar. 31, 1980

[30] Foreign Application Priority Data

Apr. 5, 1979 [IT] Italy ..... 21605 A/79

[51] Int. Cl.[3] ..... E02B 7/20

[52] U.S. Cl. ..... 405/87; 405/91; 405/115

[58] Field of Search ..... 405/91, 100, 101, 102, 405/115, 87

[56] References Cited

U.S. PATENT DOCUMENTS

| | | | |
|---|---|---|---|
| 229,136 | 6/1880 | Jennings | 405/101 |
| 4,073,147 | 2/1978 | Nomura | 405/100 |
| 4,146,346 | 3/1979 | Salo | 405/100 X |

FOREIGN PATENT DOCUMENTS

| | | | |
|---|---|---|---|
| 1146457 | 3/1963 | Fed. Rep. of Germany | 405/100 |
| 1265063 | 3/1968 | Fed. Rep. of Germany | 405/91 |
| 1237210 | 6/1960 | France | 405/100 |

*Primary Examiner*—David H. Corbin

*Attorney, Agent, or Firm*—Stevens, Davis, Miller & Mosher

[57] ABSTRACT

A collapsible dam comprising a flexible substantially rectangular substantially water repellant web stretched across the width of a waterway with one edge fixed to the bottom of the waterway and the opposite edge supported by a rigid rod adjacent to the water surface. The rigid rod is hinged with respect to the bottom of the waterway and connected at one end to a pressure actuated piston-cylinder assembly which moves the opposite end of the rod and attached web upwardly while the fixed edge remains submerged against the bottom of the waterway.

3 Claims, 2 Drawing Figures

FIG.1
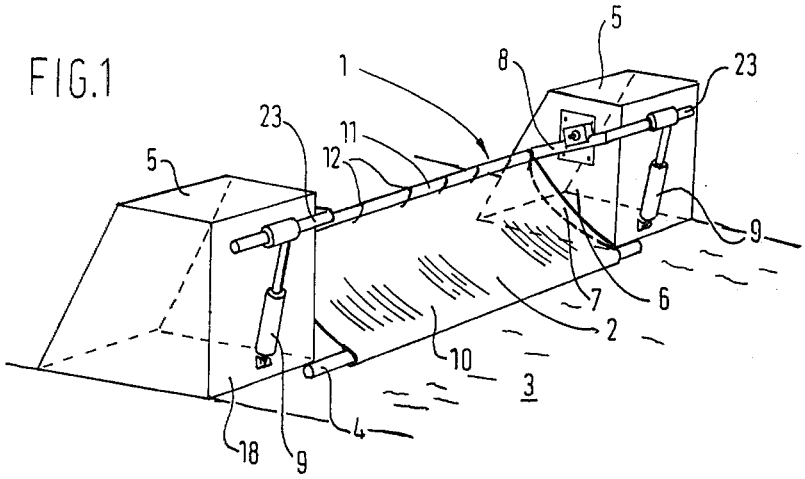
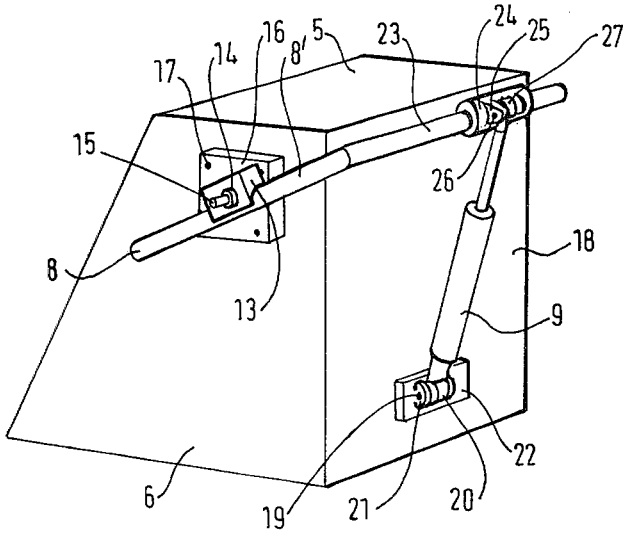
FIG.2

COLLAPSIBLE DAM AND APPARATUS FOR RAISING AND LOWERING THE DAM

This invention relates to a device for supporting, lowering and raising collapsible dams and in particular to a mechanical device actuated by means of fluid under pressure for lowering and raising collapsible dams.

In the present invention, by collapsible dam is meant a dam formed by a web of flexible, inextensible and waterproof material arranged transversally of a waterway, one edge of the web being fixed to the bottom of the waterway while the opposite edge of the web is supported so that it can be raised and lowered with respect to the bottom of the waterway.

Devices for lowering and raising collapsible dams which have tensioning rods of different types connected along the upper edge of the element constituting the dam and at the ends to the sides of the waterway where the dam is disposed are already known.

These known devices having tensioning rods are very encumbering and are difficult to maneuver when it is desired to move one or more collapsible dams placed side-by-side in the weirs of very wide watercourses because the length of the tensioning rods increases with the increase of the width of the watercourse.

Consequently, both the weight and the size of winches and of the various transmission devices used to move the tensioning rods must be increased.

An object of the present invention is to provide a device for raising and lowering one or more collapsible dams placed side-by-side across a waterway which is not very encumbering and can be maneuvered easily. Another object of the invention is to provide a dam having a flexible web to be stretched across a waterway such as a stream, river, or the like and relatively simple and effective apparatus for raising and lowering the web to accommodate increase in depth of the water. Still another object of the invention is to provide structure for supporting a flexible dam across a body of water and for raising and lowering the upper surface of the dam to respond to changes in the depth of the water.

Other objects will become apparent from the following description with reference to the accompanying drawing wherein FIG. 1 is a diagrammatic representation, in perspective, of one embodiment of the invention; and FIG. 2 is an enlarged, fragmentary perspective view of one embodiment of the raising and lowering apparatus at one end of the dam.

The foregoing objects and others are accomplished in accordance with this invention, generally speaking, by providing a device for lowering and raising a collapsible dam characterized by the fact of comprising at least one rigid rod, at a first end of said rod means for securing the rod to the upper edge of the collapsible dam and at the second end of the rod, opposite to the first end, means for raising and lowering the first end of the rod.

In its more general concept, the device according to the present invention for raising and lowering a collapsible dam has at least one rigid rod, conventional means at a first end of the rod for securing the rod to the upper edge of the collapsible dam and at the opposite end of the rigid rod means for lowering and raising the first rod end.

A preferred embodiment of the device provided by the invention for lowering and raising collapsible dams is shown in FIG. 1. FIG. 1 illustrates a collapsible dam 1 formed by a web 2 of rubberized fabric anchored to the bottom 3 of the watercourse by a rigid rod 4 inserted in a sleeve or hem present along the lower edge of web 2. Rigid rod 4 is anchored to the bottom 3 of the watercourse so as to obtain a water-tight seal between the lower edge of web 2 and the bottom 3 of the watercourse.

At the sides of the collapsible dam 1 there are post-like support members 5 against which the dam is pressed in a water-tight manner. Members 5 may be replaced with side banks of the watercourse without modifying the following description. The lateral water-tightness of the dam against the support members 5 is effected through the water pressure which presses the lateral portion 7 of the web 2 of the collapsible dam 1 against lateral walls 6 of members 5.

The collapsible dam is raised and lowered by a device having two rigid rods 8 (of which only one is shown in FIG. 1), each placed on one side of the dam, and means connected at one end of each rod 8 for raising and lowering the opposite ends of rods 8.

The means for raising and lowering dam 1 in a preferred embodiment of the invention, are cylinder-piston assemblies 9 actuated by a fluid under pressure introduced through pipes 9A and 9B to the cylinder. The device for raising and lowering the collapsible dam 1 comprises furthermore a hinged connection (described later on in the explanation of FIG. 2) for connecting at least one point of rods 8 to supporting member 5 and means for fixing the upper edge 10 of the web 2 to the end of rods 8 opposite to the end to which the assemblies 9 are connected. This means comprises a rope, or chain or preferably a rigid bar 11, arranged transversally of the watercourse, secured along each longitudinally extending edge to one of rigid rods 8, by welding or the like.

Bar 11 is connected to web 2 along the upper edge 10 of the web 2 by means of a set of loops or rings 12.

Alternatively, web 2 along its upper edge 10, is provided with a sleeve or hem in which bar 11 is inserted.

FIG. 2, as previously stated, shows a preferred embodiment of the hinged connection to connect at least one point of each rigid rod 8 to the lateral wall 6 of each support member 5.

A preferred embodiment of the hinged connection comprises a prism 13 welded to each rod 8, the prism being provided with a circular seat 14 in which a pin 15 is inserted. Pin 15 is fixed to and projects from a plate 16 fixed by means of bolts 17 to lateral wall 6 of support member 5.

Moreover, FIG. 2 shows a preferred embodiment of the system to fix the cylinder-piston assembly 9 to the ground, in particular with the member 5 and to fix the cylinder-piston assembly 9 to rigid rod 8.

The anchorage of cylinder-piston assembly 9 to the support member 5 comprises a hinged connection between assembly 9 and the front face 18 of support member 5, the hinged connection being constituted by a pin 19 which locks a toggle loop 20 at the end of the cylinder of assembly 9 between two eyes 21 carried by a plate 22 connected to front wall 18 of support member 5.

Likewise, the hinged connection between assembly 9 and the rod 8 is achieved. Preferably, the end 8′ of rod 8 has an extended portion 23 (see also FIG. 1) on which a sleeve 24 provided with two eyes 25 is welded. A toggle loop 27 placed at the end of the stem of the piston of the assembly 9, is fixed by means of a pin 26 between eyes 25.

In an alternative embodiment (not shown in the Figures) of a device for raising and lowering a collapsible dam according to the present invention, the cylinder-piston assembly 9 has its axis parallel to the axis of the rod 8 and the connection of one point of rod 8 to the support member 5, if made necessary by the dimensions of the rod 8, is made through a suitable seat provided with a groove in which the rod 8 can slide, the seat being appropriately secured to the lateral wall of support member 5. In particular, for some applications, a device in which the stem of the piston of the cylinder-piston assembly 9 coincides with the rigid rod 8 is advantageous. In that case, the outer surface of the cylinder is secured to the lateral wall of support member 5.

In an additional embodiment (not shown in the figures) of a device for raising and lowering collapsible dams according to the present invention, the device comprises, as means for raising and lowering the end of the rod 8 to which the upper edge of the collapsible dam is fixed, a motor of any type disposed for example, in support member 5, a shaft rotated by the motor projecting from a lateral wall 6 of support member 5, the shaft acting also as a pin around which the seat 14 on rod 8 rotates, the motion being transmitted by the shaft to seat 14 through conventional means such as a splined coupling.

Furthermore, the device for raising and lowering a collapsible dam represented in FIGS. 1 and 2 is suitable for moving a plurality of collapsible dams placed side-by-side. In fact, supposing that another collapsible dam is placed laterally of the collapsible dam 1 shown in FIG. 1, it is possible to extend the free end of extended portion 23 up to the end 8' of the rigid rod 8 of the adjacent dam and to secure it thereto in order to maneuver both of the dams with a single cylinder-piston assembly 9.

As a matter of fact, by means of this system it is only necessary to provide one cylinder-piston assembly per dam placed side-by-side plus one. In other words it is sufficient to provide a number of cylinder-piston assemblies 9 corresponding to the number of the support members 5 present in the watercourse.

The operation of a device to raise and lower the collapsible dam starting with the dam in the condition shown in FIG. 1, i.e., with the collapsible dam in its raised position is the following. In order to lower the dam fluid under pressure is introduced into the cylinder of the cylinder-piston assembly 9 in such a way as to move the stem of the piston out of the cylinder.

In this way the end 8' of the rigid rod 8 is raised and rotated around the pin 15. The opposite end of rigid rod 8 is lowered and carrys edge 10 of the web 2 with it. Thus, the lowering of the collapsible dam takes place.

In order to raise the collapsible dam 1 it is necessary instead to introduce the fluid under pressure into the cylinder of the cylinder-piston assembly 9 in such a way to have the piston pull the stem into the cylinder.

This results in lowering of the end 8' of the rigid rod 8 with the rotation of rod 8 around the pin 15 and raising of the end of rod 8 to which the upper edge 10 of the web 2 of the dam 1 is fixed.

Consequently, the dam is raised. It can be easily understood that the raising or the lowering of collapsible dam 1 can be only partial, by regulating appropriately the supply of fluid under pressure to the cylinder-piston assemblies 9.

Moreover, by counterbalancing appropriately, for example, the bar 11, a cylinder-piston assembly 9 can be utilized in which the fluid under pressure is used only for the raising phase of the collapsible dam 1 with the advantage that the dam will not remain blocked in the raised position in case of failure of the plant for supplying fluid under pressure.

This can be advantageous in case of sudden floods of the watercourse since the dam can be automatically lowered even if the source of compressed fluid fails.

Moreover, a system can be provided for lowering automatically the dam in the case of an unexpected flood with use of the force of the water and of the counterweight. However, this system must be provided with a device, not shown, including a float placed in the watercourse, upstream of the dam and connected by means of a rod to the cylinder-piston assemblies, and in particular to the valves placed on the cylinders of each cylinder-piston assembly, so as to open the valves after the raising of the float beyond a predetermined level, thereby discharging the liquid under pressure contained in the cylinders.

From the description of the device provided by the invention for lowering and raising a collapsible dam, it can be seen how the predetermined purposes are achieved.

In fact, the device according to the invention will lower and raise one or more dams placed side-by-side with the minimum encumbrance.

Moreover, the device of the present invention is reliable and safe.

Although particular embodiments of the device according to the present invention for raising and lowering collapsible dams have been described and illustrated, it is understood that the invention is not limited to such detail except as it may be limited by the claims.

What is claimed is:

1. A device for raising and lowering a web of flexible, inextensible and waterproof material forming a dam arranged transversely of a waterway, one edge of the web being fixed to the bottom of the waterway while the opposite edge is supported so it can be raised and lowered by the device, said device comprising at least one rigid rod secured at one end to said supported edge of the web while the second end, opposite to the first end is secured to means for raising and lowering said first end comprising a pressure cylinder-piston assembly actuated by means of a fluid under pressure, one end of said assembly being attached to the ground and the other end of said assembly being attached to said second end of the rod, said rigid rod being further connected to a bank of the waterway by means of a hinged connection comprising a circular seat associated to an intermediate point of said rod, and a pin inserted in said seat, said pin being secured in such a way as to project from a wall of the waterway in which the web forms the dam whereby when said second end is displaced upwardly or downwardly by said pressure cylinder-piston assembly the rigid rod swings around said hinged connection thereby lowering or raising the first end and consequently also the web attached thereto.

2. A collapsible dam installed across a flowing waterway comprising a flexible web spanning the width of the waterway and having top and bottom edges, a first rigid rod spanning the width of the waterway along said upper edge and a second rigid rod spanning the width of the waterway along said bottom edge and along the bottom of the waterway, and means for moving said first rigid rod towards and away from the water surface comprising a pressure cylinder, a piston slidably disposed in the said cylinder and responsive to a fluid under pressure, a piston rod fixed to the piston and protruding from the cylinder, rod means connecting said first rigid rod to the piston rod for movement therewith, stationary means disposed alongside said waterway at one end of said web for supporting said pressure cylinder, said stationary means having a first upstanding wall and a second upstanding wall which has an edge which joins the first wall at an angle of less than 180° and faces the waterway, means disposed above and against said rod means on said second wall forming a fulcrum about which said rod pivots, whereby when said rod means is moved by said piston rod on one side of said means disposed above the rod means, the portion of the rod means on the opposite side of the said means disposed above the rod means moves in a direction vertically opposite to movement by the piston rod to move the flexible web therewith.

3. The dam of claim 2 wherein said web is a rubberized fabric.

* * * * *